US005670925A

United States Patent [19]

Gibbs

[11] Patent Number: 5,670,925

[45] Date of Patent: Sep. 23, 1997

[54] BOBBIN, BOBBIN AND CORE ASSEMBLY, AND INDUCTOR COIL ASSEMBLY FOR ELECTRONIC BALLAST

[75] Inventor: Michael J. Gibbs, Enfield, Conn.

[73] Assignee: Osram Sylvania Inc., Danvers, Mass.

[21] Appl. No.: 711,839

[22] Filed: Sep. 10, 1996

[51] Int. Cl.[6] ..... H01F 27/28; H01F 27/30; H01F 27/06

[52] U.S. Cl. ..... 336/208; 336/198; 336/208; 336/65

[58] Field of Search ..... 336/208, 198, 336/65, 192

[56] References Cited

U.S. PATENT DOCUMENTS

| | | | |
|---|---|---|---|
| 4,250,479 | 2/1981 | Bausch et al. | 336/208 |
| 4,380,748 | 4/1983 | Hill et al. | 335/151 |
| 4,408,817 | 10/1983 | Mattis | 339/147 |
| 4,419,814 | 12/1983 | Hasserjian | 29/605 |
| 4,462,016 | 7/1984 | Bland et al. | 336/192 |
| 4,503,413 | 3/1985 | Stalzer | 336/208 |
| 4,617,543 | 10/1986 | Akachi et al. | 336/192 |
| 4,662,572 | 5/1987 | Bland et al. | 242/7.03 |
| 4,701,735 | 10/1987 | Hill et al. | 335/282 |
| 4,771,257 | 9/1988 | Gunnels et al. | 336/160 |
| 4,774,756 | 10/1988 | Dehtienne | 29/605 |
| 4,853,667 | 8/1989 | Freimuth et al . | 336/192 |
| 4,857,878 | 8/1989 | Eng, Jr. et al. | 336/192 |
| 5,008,644 | 4/1991 | Cooper | 336/208 |
| 5,315,280 | 5/1994 | Stokes et al. | 336/192 |
| 5,332,989 | 7/1994 | Ching | 336/208 |
| 5,420,559 | 5/1995 | Ohshiba et al. | 336/208 |
| 5,600,294 | 2/1997 | Buenconsejo et al. | 336/192 |

FOREIGN PATENT DOCUMENTS

| | | | |
|---|---|---|---|
| 60-7114 | 1/1985 | Japan | 336/198 |

*Primary Examiner*—Michael L. Gellner
*Assistant Examiner*—Anh Mai
*Attorney, Agent, or Firm*—Carlo S. Bessone

[57] ABSTRACT

A bobbin and core assembly includes a bobbin for supporting a pair of discrete windings. The bobbin includes a central body, first and second inner flanges fixed to first and second ends of the body, first and second tubular portions extending outwardly from the first and second inner flanges, first and second outer flanges fixed to outer ends of the first and second tubular portions, the inner and outer flanges defining first and second channels for receiving first and second of the windings. The assembly further includes first and second outer core members, each having a core portion extending from a base portion and between two leg portions generally parallel with the outer core member core portion, and first and second inner core members each having a core portion extending from a base portion and between two leg portions. The first outer flange, first tubular portion and first inner flange define a first tunnel in which is disposed the first outer core member core portion and the second outer flange, second tubular portion, and second inner flange define a second tunnel in which is disposed the second outer core member core portion. The central body of the bobbin is provided with an opening extending widthwise therethrough and in communication with the tunnels. The first and second inner core members are disposed in the central body opening with the first and second inner core member core portions disposed in the first and second tunnels.

18 Claims, 4 Drawing Sheets

BOBBIN, BOBBIN AND CORE ASSEMBLY, AND INDUCTOR COIL ASSEMBLY FOR ELECTRONIC BALLAST

BACKGROUND OF THE INVENTION (1) Field of the Invention

This invention relates to inductor coil assemblies and is directed more particularly to an improved bobbin, bobbin and core assembly, and inductor coil assembly of the type used in electronic ballasts.

(2) Description of the Prior Art

Inductor coil assemblies for electronic ballasts are known in the art. In ballasts for fluorescent lamps, for example, it is common to mount a pair of inductors on a printed circuit board. Each inductor typically comprises an annular ferrite core having electrically conductive wire wound around the outer periphery of the core and through the annulus of the core. Each of the wire ends are connected to pins which extend through holes in the circuit board and extend slightly from an underside of the circuit board, where the pins are joined to the circuit of the ballast. The two inductors are wound and mounted independently of each other, with the pins serving as pedestals for supporting the inductors on a deck surface of the board.

It is deemed of benefit to replace the two discrete inductors with a single component supporting two windings and adapted to be handled as a single unit which is easily and inexpensively manufactured and affixed to the circuit board.

SUMMARY OF THE INVENTION

An object of the invention is to provide a bobbin for supporting two discrete windings for connecting the windings to a circuit board, and for receiving appropriate core members.

A further object of the invention is to provide a bobbin and core assembly for two discrete windings, including means for mounting the assembly on a circuit board.

A still further object of the invention is to provide an inductor coil assembly including two discrete windings and means for mounting the assembly on a circuit board.

A still further object of the invention is to provide an inductor assembly including a circuit board, with the windings being in contact with a circuit disposed on the circuit board.

With the above and other objects in view, as will hereinafter appear, a feature of the present invention is the provision of a bobbin to support a pair of discrete windings, the bobbin comprising a central body having first and second ends, a first inner flange fixed to a first end of the central body, and a second inner flange fixed to a second end of the body, a first cylindrically-shaped tubular portion extending axially outwardly from the first inner flange, the first tubular portion being in axial alignment with the central body, and a second cylindrically shaped tubular portion extending axially outwardly from the second inner flange, the second tubular portion being in axial alignment with the central body. The bobbin further includes a first outer flange fixed to an outer end of the first tubular portion and a second outer flange fixed to an outer end of the second tubular portion, the first inner flange and the first outer flange defining a first channel for receiving a first of the pair of windings upon the first tubular portion, and the second inner flange and the second outer flange defining a second channel for receiving a second of the pair of windings upon the second tubular portion. The first outer flange, the first tubular portion, and the first inner flange define a first tunnel for receiving a first outer core member core portion through a first outer opening, and the second outer flange, the second tubular portion and the second inner flange define a second tunnel for receiving a second outer core member core portion through a second outer opening. The central body is provided with opening means extending widthwise therethrough and in communication with first and second inner openings of the first and second tunnels, respectively, the central body opening being of shape and size suitable for receiving first and second inner core members with the first and second inner openings being adapted to receive, respectively, first and second core portions of the first and second inner core member.

In accordance with a further feature of the invention, there is provided a bobbin and core assembly comprising a bobbin for supporting a pair of discrete windings, the bobbin comprising a central body having first and second ends, first and second inner flanges fixed, respectively, to the first and second ends of the body, first and second cylindrically-shaped tubular portions extending, respectively, outwardly from said first and second inner flanges and in axial alignment with the central body, first and second outer flanges fixed, respectively to first and second outer ends of the first and second tubular portions, the inner and outer flanges defining first and second channels for receiving first and second of the windings upon, respectively, the first and second tubular portions. The assembly further includes first and second outer core members, each having an outer core member core portion extending from an outer core member base portion and between two outer core member leg portions generally parallel with the outer core member core portion, and first and second inner core members, each having an inner core member core portion extending from an inner core member base portion and between two inner core member leg portions generally parallel with the inner core member core portion. The first outer flange, the first tubular portion and the first inner flange define a first tunnel in which is disposed the first outer core member core portion and the second outer flange, the second tubular portion, and the second inner flange define a second tunnel in which is disposed the second outer core member core portion. The central body of the bobbin is provided with opening means extending widthwise therethrough and in communication with first and second inner openings of the first and second tunnels, respectively. The first and second inner core members are disposed in the central body opening means with the first and second inner core member core portions being respectively disposed in the first and second inner openings and the first and second tunnels, ends of the first and second inner core member core portions respectively abutting ends of the first and second outer core member core portions.

In accordance with a still further feature of the invention, there is provided an inductor coil assembly comprising a central body having first and second ends, first and second inner flanges fixed, respectively to the first and second ends of the body, first and second cylindrically-shaped tubular portions extending, respectively, outwardly from the first and second inner flanges and in axial alignment with the central body, first and second outer flanges fixed, respectively to first and second outer ends of the first and second tubular portions. The inner and outer flanges define first and second channels, respectively, around the first and second tubular portions. The assembly further includes first and second outer core members, each having an outer core member core portion extending from an outer core member base portion and between two outer core member leg portions generally parallel with the outer core member core portion. The first and second inner core members each are provided with an inner core member core portion extending from an inner core member base portion and between two inner core member leg portions generally parallel with the inner member core portion. The first outer flange, the first tubular portion, and the first inner flange define a first tunnel in which is disposed the first outer core member core portion, and the second outer flange, the second tubular portion, and the second inner flange define a second tunnel in which is disposed the second outer core member core portion. The central body of the bobbin is provided with opening means extending widthwise therethrough and in communication with first and second inner openings of the first and second tunnels, respectively. The first and second inner core members are disposed in the central body opening means with the first and second inner core member core portions being, respectively, disposed in the first and second tunnels, ends of the first and second inner core member core portions respectively abutting ends of the first and second outer core member core portions. A first winding is disposed on the first tubular portion and in the first channel, and a second winding is disposed on the second tubular portion and in the second channel.

In accordance with a still further feature of the invention, there is provided an inductor coil assembly as described immediately above, wherein the assembly further comprises a first footing extending from the first outer flange and a second footing extending from the second outer flange, and a circuit board having holes therein. Each of the windings extend through holes in the footings and extend beyond undersurfaces of the footings, the winding ends extending through and fixed in the circuit board holes to connect the footings to the circuit board and to connect the windings to a circuit disposed on a surface of the circuit board.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 3:
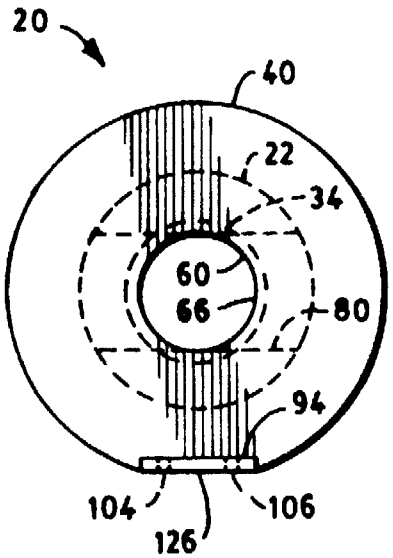
FIG. 3 is an end view of the bobbin of FIG. 1.
Figure 1:
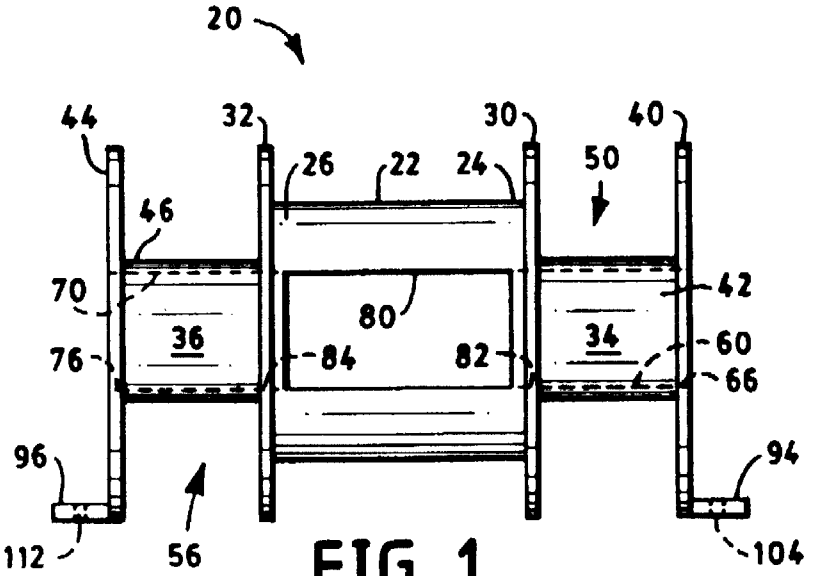
FIG. 1 is a front elevational view of one form of bobbin illustrative of an embodiment of the invention.
Figure 2:
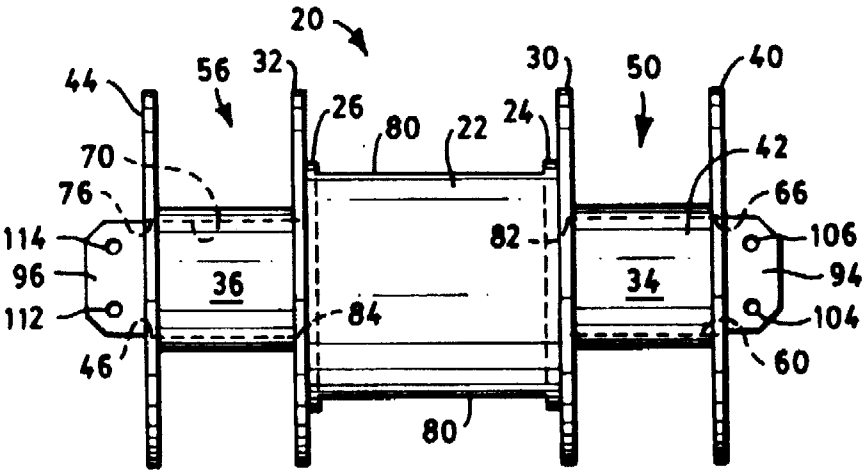
FIG. 2 is a top plan view of the bobbin of FIG. 1.

Referring to FIGS. 1–3, it will be seen that an illustrative bobbin 20 includes a central body 22 having first and second ends 24, 26. A first inner flange 30 is fixed to the first end 24 of the central body 22 and a second inner flange 32 is fixed to the second end 26 of the central body 22.

A first cylindrically-shaped tubular portion 34 extends axially outwardly (rightwardly as viewed in FIGS. 1 and 2) from the first inner flange 30, with the first tubular portion 34 in axial alignment with the central body 22. A second cylindrically-shaped tubular portion 36 extends axially outwardly (leftwardly as viewed in FIGS. 1 and 2) from the second inner flange 32, with the second tubular portion 36 in axial alignment with the central body 22.

A first outer flange 40 is fixed to an outer end 42 of the first tubular portion 34 and a second outer flange 44 is fixed to an outer end 46 of the second tubular portion 36.

Figure 4:
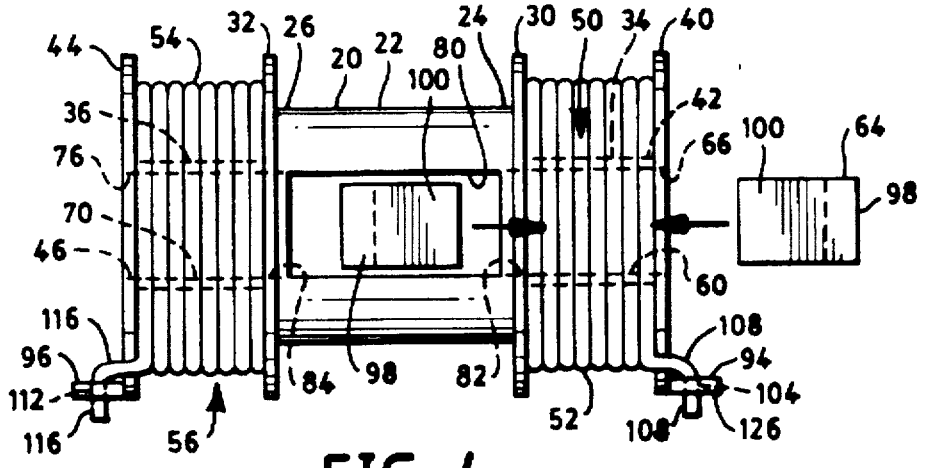
FIG. 4 is a front elevational view of the bobbin of FIG. 1 with core members shown positioned for insertion and with windings disposed on the bobbin.
Figure 5:
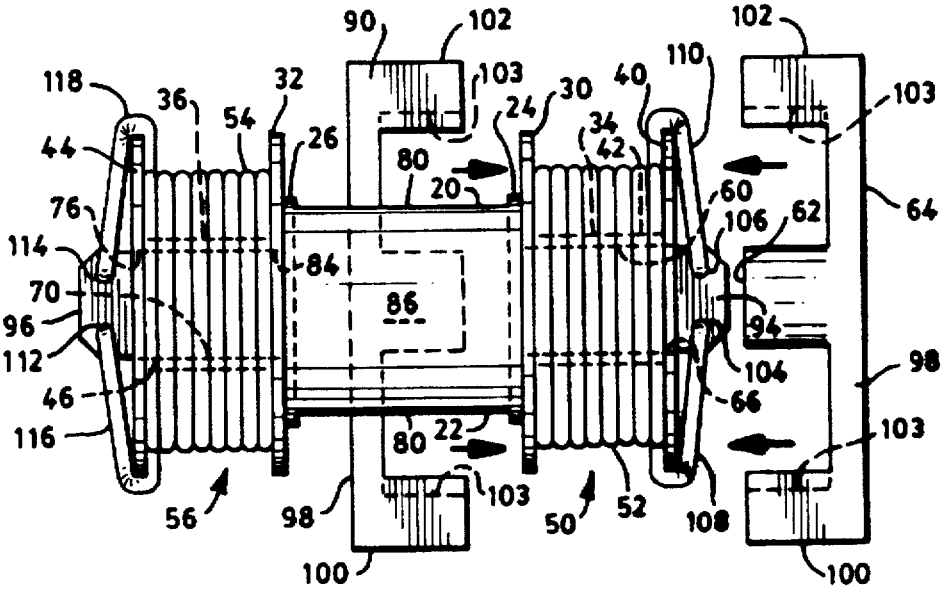
FIG. 5 is a top plan view of the bobbin and winding assembly components of FIG. 4.

The first inner flange 30 and the first outer flange 40 define therebetween a first channel 50 for receiving upon the first tubular portion 34 a first winding 52 of a pair of windings 52, 54 (FIGS. 4 and 5) and the second inner flange 32 and the second outer flange 44 define therebetween a second channel 56 for receiving the second winding 54 upon the second tubular portion 36.

The first outer flange 40, first tubular portion 34, and first inner flange 30 define a first tunnel 60 for receiving a core portion 62 (FIG. 5) of a first outer core member 64 through a first outer opening 66. The second outer flange 44, second tubular portion 36, and second inner flange 32 define a second tunnel 70 for receiving a core portion 72 (FIG. 8) of a second outer core member 74 through a second outer opening 76.

The central body 22 is provided with an opening 80 extending widthwise therethrough and in communication with first and second inner openings 82, 84 of the first and second tunnels 60, 70, respectively. The central body opening 80 is of a shape and size suitable for receiving first and second inner core members 90, 92, (FIGS. 5, 7 and 8), with the first and second inner openings 82, 84 being adapted to receive respectively, core portions 86, 88 of the first and second inner core members 90, 92 (FIG. 8).

The bobbin 20 is provided with a first footing 94 fixed to and extending from the first outer flange 40, and a second footing 96 fixed to and extending from the second outer flange 44.

Each of the core members 64, 74, 90, 92 includes a base portion 98, from which the core portions 62, 72, 86, 88 extend and from which leg portions 100, 102 extend, the leg portions 100, 102 and the core portions being generally parallel to each other and normal to their respective base portions 98.

To accommodate placement of the inner core members 90, 92, the opening 80 is of a length L (FIG. 8) at least equal to, and preferably slightly larger than, the width ($l_2$) of an inner core member base portion 98 plus the width ($l_1$) of an entire inner core member. The inner core members 90, 92 are of equal size and configuration. Thus, the first inner core member 90 may be inserted into the opening 80 and slid rightwardly, as viewed in FIG. 5, such that the first inner core portion 86 is disposed in the first tunnel 60 (FIG. 8). Thereafter, the second inner core member 92 is inserted into the opening 80 and slid leftwardly such that the second inner core portion 88 is disposed in the second tunnel 70. The outer core members 64, 74 are then slid into place, with the first outer core member core portion 62 passing through the first outer opening 66 end into the first tunnel 60 to abut the end of the first inner core portion 86, and the second outer core member core portion 72 passing through the second outer opening 76 and into the second tunnel 70 to abut the end of the second inner core portion 88.

The leg portions 100, 102 of the first outer core member 64 extend inwardly of the bobbin 20 adjacent to the periphery of the first outer flange 40 (FIG. 8) and over the first channel 50. The first inner core member leg portions 100, 102 extend outwardly of the bobbin 20, adjacent to the periphery of the first inner flange 30 and over the first channel 50, with ends of the first outer core member leg portions abutting, respectively, the first inner core member leg portions. Similarly, the second outer core member leg portions 100, 102 extend inwardly of the bobbin 20 adjacent to the periphery of the second outer flange 44 and over the second channel 56. The second inner core leg portions 100, 102 extend outwardly of the bobbin 20 adjacent the periphery of the second inner flange 32 and over the second channel 56, with ends of the second outer core member leg portions abutting ends of the second inner core member leg portions. The leg portions 100, 102 may be provided with curved inside surfaces 103 shaped complementarily to the peripheries of the flanges 30, 32, 40, 44.

The core members 64, 74, 90, 92 are of ferrite material and the abutting ends of the leg portions 100, 102 and core portions 62, 72 preferably are bonded together, as by adhesive. The bobbin 20 is of a rigid material, preferably a unitary molding of a rigid plastics material.

The core member core portions 62, 72, 86, 88 preferably are of cylindrical shape, but may be rectangular in cross-section, as is known in the art. The tunnels 60, 70 must be complementary to the core portions 62, 72, 86, 88 such that the core portions are readily received in the tunnels 60, 70.

Before securing the core members 64, 74 90, 92 to the bobbin 20, the bobbin channels 50, 56 are wound each with a discrete winding, such that the first discrete winding 52 is wound on the first tubular portion 34 and is disposed in the first channel 50 and the second winding 54 is disposed on the second tubular portion 36 and in the second channel 56 (FIGS. 4, 5, 7 and 8).

Figure 6:
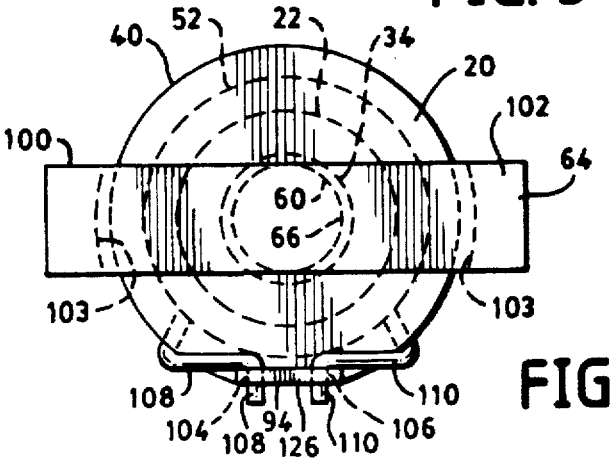
FIG. 6 is an end view of a bobbin and core assembly illustrative of another embodiment of the invention.

The first footing 94 is provided with first and second holes 104, 106 extending therethrough. A first free end 108 (FIGS. 4–6, 7 and 9) of the first winding 52 extends through the first footing first hole 104. A second free end 110 (FIGS. 5, 6 and 9) of the first winding 52 extends through the first footing second hole 106. Similarly, the second footing 96 is provided with first and second holes 112, 114 therethrough. A first free end 116 (FIGS. 4, 5 and 7) of the second winding 54 extends through the second footing first hole 112, and a second free end 118 (FIG. 5) of the second winding 54 extends through the second footing second hole 114.

Figure 7:
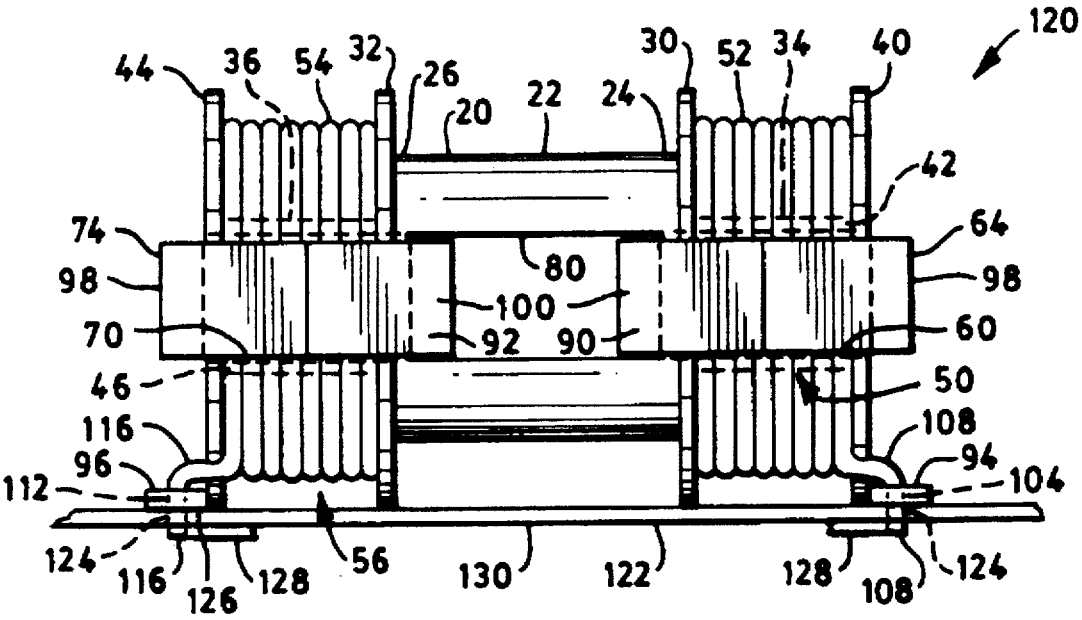
FIG. 7 a front elevational view of an inductor coil assembly illustrative of another embodiment of the invention.
Figure 8:
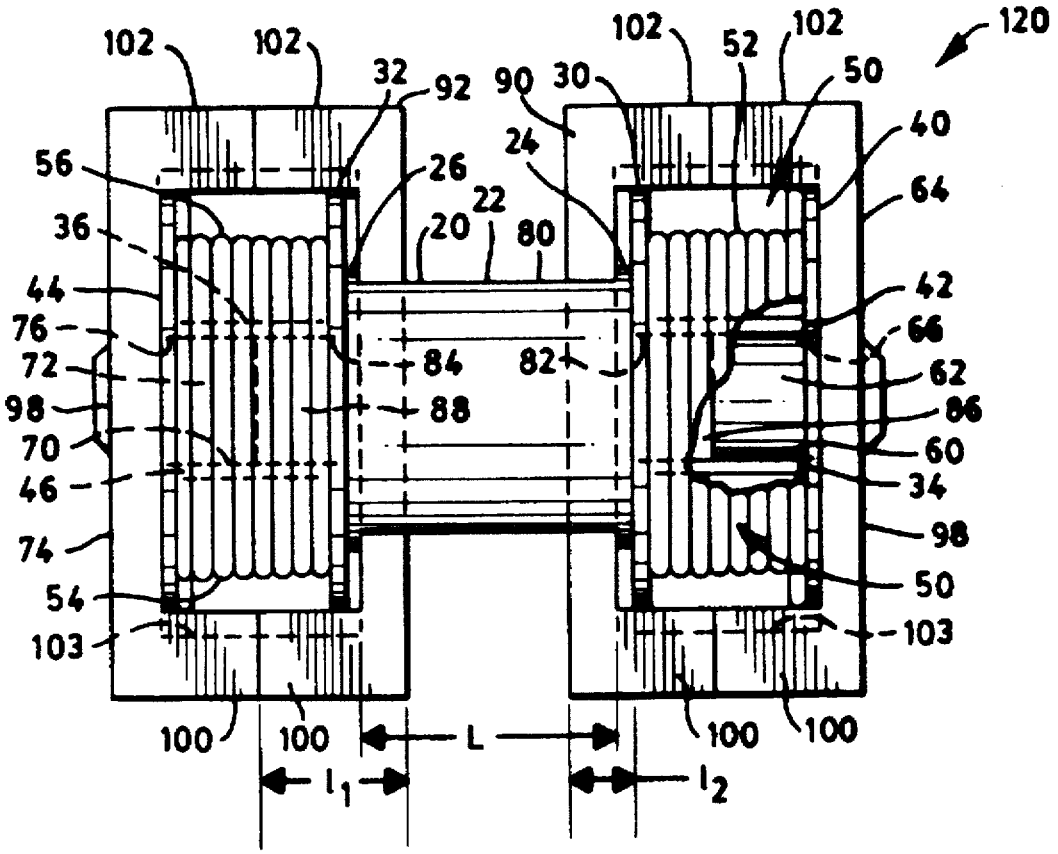
FIG. 8 is a top plan view, broken away, of the bobbin and core assembly of FIG. 6.
Figure 9:
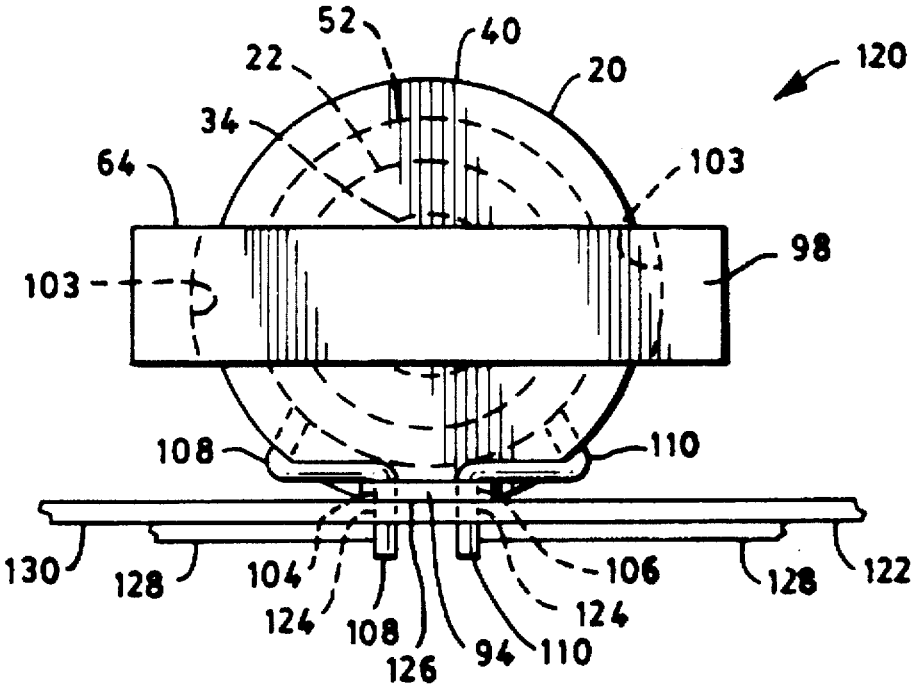
FIG. 9 is an end view of the inductor coil assembly of FIG. 7.

Referring to FIGS. 7 and 9, it will be seen that an inductor coil assembly 120 comprising the bobbin 20, the windings 52, 54 and the core members 64, 74, 90, 92 may be mounted on a circuit board 122 having holes 124 therein. The inductor coil assembly 120 is fixed to the circuit board 122 by extending the free ends 108, 110, 116, 118 of the windings 52, 54, which extend beyond undersurfaces 126 of the footings 94, 96, through the circuit board holes 124. The winding ends 108, 110, 116, 118 are then connected, as by soldering, or the like, to a circuit 128 disposed on a surface 130 (FIGS. 7 and 9) of the circuit board 122.

Figure 10:
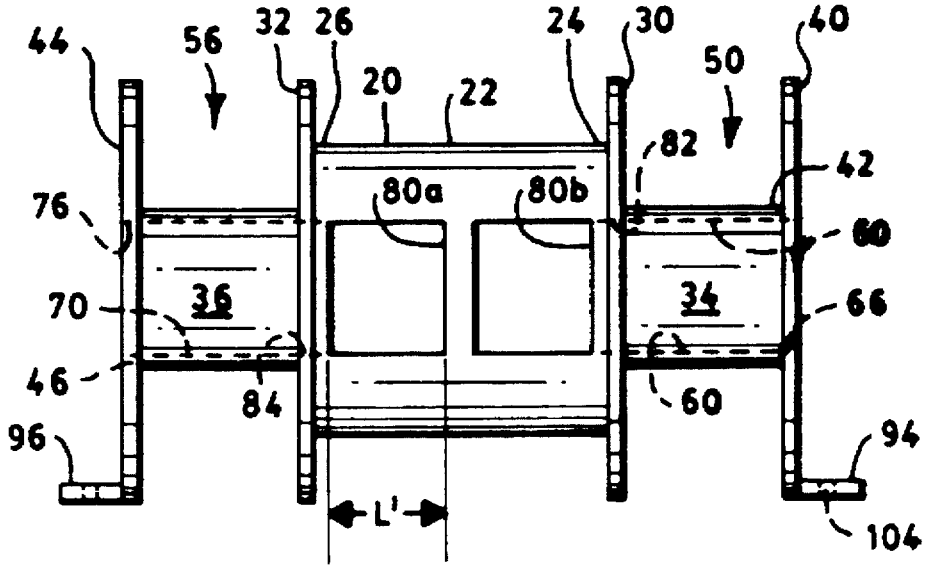
FIG. 10 is similar to FIG. 1, but illustrative of an alternative embodiment of bobbin.

Referring to FIG. 10, it will be seen that in an alternative embodiment, the bobbin 20 is provided with two openings 80*a*, 80*b*. In this embodiment, each opening 80*a*, 80*b*, accepts an inner core member 90, 92. Thus, each of the openings 80*a*, 80*b* is provided with a length L' at least equal to the width $l_1$ of an inner core member.

There is thus provided a bobbin 20 for supporting two discrete windings 52, 54, which may be wound simultaneously on the bobbin, the bobbin being moldable as a single unitary body, and having footings 94, 96 thereon and integral therewith for mounting of the bobbin on a circuit board 122.

There is further provided a bobbin and core assembly including the bobbin 20 summarized immediately above, in combination with core members 64, 74, 90, 92 which are easily mounted on the bobbin.

There is still further provided an inductor coil assembly 120 including the bobbin and core assembly summarized immediately above and two discrete windings 52, 54 fixed on the bobbin 20.

There is still further provided an inductor coil assembly as summarized immediately above, further including a circuit board 122, with the windings being so mounted as to be easily fixed to the circuit board and joined to a circuit 128 thereon.

It is to be understood that the present invention is by no means limited to the particular constructions herein disclosed and/or shown in the drawings, but also comprises any modifications or equivalents within the scope of the claims.

Having thus described my invention, what I claim as new and desire to secure by Letters Patent of the United States is:

1. A bobbin and core assembly comprising:

a bobbin for supporting a pair of discrete windings, said bobbin comprising:

a central body having first and second ends;

first and second inner flanges fixed, respectively, to said first and second ends of said central body;

first and second cylindrically-shaped tubular portions extending, respectively, outwardly from said first and second inner flanges and in axial alignment with said central body;

first and second outer flanges fixed, respectively, to first and second outer ends of said first and second tubular portions;

said inner and outer flanges defining first and second channels for receiving first and second of said windings upon, respectively, said first and second tubular portions;

first and second outer core members, each having an outer core member core portion extending from an outer core member base portion and between two outer core member leg portions generally parallel with said outer core member core portion; and first and second inner core members each having an inner core member core portion extending from an inner core member base portion and between two inner core member leg portions generally parallel with said inner core member core portion;

said first outer flange, said first tubular portion and said first inner flange defining a first tunnel in which is disposed said first outer core member core portion, and said second outer flange, said second tubular portion, and said second inner flange defining a second tunnel in which is disposed said second outer core member core portion;

said central body of said bobbin being provided with opening means extending widthwise therethrough and in communication with first and second inner openings of said first and second tunnels, respectively;

said first and second inner core members being disposed in said central body opening means with said first and second inner core member core portions being respectively disposed in said first and second inner openings and said first and second tunnels;

ends of said first and second inner core member core portions respectively abutting ends of said first and second outer core member core portions.

2. The bobbin and core assembly in accordance with claim 1 wherein said first outer core member leg portions extend inwardly of said bobbin adjacent to a periphery of said first outer flange and over said first channel, said first inner core member leg portions extend outwardly of said bobbin adjacent to a periphery of said first inner flange and over said first channel, with ends of said first outer core member leg portions abutting ends of said first inner core member leg portion; and said second outer core member leg portions extend inwardly of said bobbin adjacent to a periphery of said second outer flange and over said second channel, said second inner core member leg portions extend outwardly of said bobbin adjacent a periphery of said second inner flange and over said second channel, with ends of said second outer core member leg portions abutting ends of said second inner core member leg portions.

3. The bobbin and core assembly in accordance with claim 2 wherein said first outer core member is bonded to said first inner core member; and said second outer core member is bonded to said second inner core member.

4. The bobbin and core assembly in accordance with claim 3 wherein said bobbin is of a rigid plastic material and said core members are of a ferrite material.

5. The bobbin and core assembly in accordance with claim 3 wherein said core member core portions are each cylindrically shaped and sized to be received by said first and second tubular portions.

6. The bobbin and core assembly in accordance with claim 1 wherein said inner core members are of equal size and configuration and said central body opening means comprises an opening provided with a length extending between said first and second inner flanges at least equal to a width of one of said inner core members plus a width of said base portion of the other of said inner core members.

7. The bobbin and core assembly in accordance with claim 1 wherein said central body opening means comprises first and second openings, said first opening being provided with a length extending between said first and second inner flanges at least equal to a width of said first core member; and said second opening being provided with a length extending between said first and second inner flanges at least equal to a width of said second core member.

8. The bobbin and core assembly in accordance with claim 7 wherein said bobbin further comprises a first footing fixed to and extending from said first outer flange and a second footing fixed to and extending from said second outer flange.

9. An inductor coil assembly comprising:

a bobbin comprising:

a central body having first and second ends; first and second inner flanges fixed, respectively, to said first and second ends of said central body;

first and second cylindrically-shaped tubular portions extending, respectively, outwardly from said first and second inner flanges and in axial alignment with said central body;

first and second outer flanges fixed, respectively, to first and second outer ends of said first and second tubular portions;

said inner and outer flanges defining first and second channels, respectively, around said first and second tubular portions;

first and second outer core members each having an outer core member core portion extending from an outer core member base portion and between two outer core member leg portions generally parallel with said outer core member core portion; and first and second inner core members each having an inner core member core portion extending from an inner core member base portion and between two inner core member leg portions generally parallel with said inner core member core portion;

said first outer flange, said first tubular portion, and said first inner flange defining a first tunnel in which is disposed said first outer core member core portion, and said second outer flange, said second tubular portion, and said second inner flange defining a second tunnel in which is disposed said second outer core member core portion;

said central body of said bobbin being provided with opening means extending widthwise therethrough and in communication with first and second inner openings of said first and second tunnels, respectively;

said first and second inner core members being disposed in said central body opening means with said first and second inner core member core portions being respectively disposed in said first and second tunnels, ends of said first and second inner core member core portions respectively abutting ends of said first and second outer core member core portions;

a first winding disposed on said first tubular portion and in said first channel; and a second winding disposed on said second tubular portion and in said second channel.

10. The inductor coil assembly in accordance with claim 9 wherein said first outer core member leg portions extend inwardly of said bobbin adjacent to a periphery of said first outer flange and over said first winding, said first inner core member leg portions extend outwardly of said bobbin adjacent to a periphery of said first inner flange and over said first winding, with ends of said first outer core member leg portions abutting ends of said first inner core member leg portions; and said second outer core member leg portions extend inwardly of said bobbin adjacent to a periphery of said second outer flange and over said second winding, said second inner core member leg portions extend outwardly of said bobbin adjacent a periphery of said second inner flange and over said second winding, with ends of said second outer core member leg portions abutting ends of said second inner core member leg portions.

11. The inductor coil assembly in accordance with claim 10 wherein said first outer core member is bonded to said first inner core member; and said second outer core member is bonded to said second inner core member.

12. The inductor coil assembly in accordance with claim 11 wherein said bobbin is of a rigid plastic material and said core members are of a ferrite material.

13. The inductor coil assembly in accordance with claim 11 wherein said core member core portions are each cylindrically shaped and sized to be received by said first and second tubular portions.

14. The inductor coil assembly in accordance with claim 11 wherein said inner core members are of equal size and configuration and said central body opening means comprises an opening provided with a length extending between said first and second inner flanges at least equal to a width of one of said inner core members plus a width of said base portion of the other of said inner core members.

15. The inductor coil assembly in accordance with claim 9 wherein said central body opening means comprises first and second openings, said first opening being provided with a length extending between said first and second inner flanges at least equal to a width of said first core member; and said second opening being provided with a length extending between said first and second inner flanges at least equal to a width of said second core member.

16. The inductor coil assembly in accordance with claim 15 wherein said bobbin further comprises a first footing fixed to and extending from said first outer flange and a second footing fixed to and extending from said second outer flange.

17. The inductor coil assembly in accordance with claim 16 wherein said first footing is provided with first and second holes therethrough, a first free end of said first winding disposed in said first footing first hole and a second free end of said first winding disposed in said first footing second hole; and said second footing is provided with first and second holes therethrough, a first free end of said second winding disposed in said second footing first hole and a second free end of said second winding disposed in said second footing second hole.

18. The inductor coil assembly in accordance with claim 17, wherein said assembly further comprises a circuit board having holes therein, said winding ends extending through said footing holes in said footings and extending beyond undersurfaces of said footings, said winding ends extending through and fixed in said circuit board holes to connect said footings to said circuit board and to connect said windings to a circuit disposed on a surface of said circuit board.

* * * * *